US008177230B2

(12) United States Patent
Jiang et al.

(10) Patent No.: US 8,177,230 B2
(45) Date of Patent: May 15, 2012

(54) RECORDING MEDIUM ACCUMULATING DEVICE AND METHOD

(75) Inventors: Tianxin Jiang, Shandong (CN); Zhengmin Zhang, Shandong (CN); Xiangang Yang, Shandong (CN)

(73) Assignee: Shandong New Beiyang Information Technology Co., Ltd. (CN)

( * ) Notice: Subject to any disclaimer, the term of this patent is extended or adjusted under 35 U.S.C. 154(b) by 226 days.

(21) Appl. No.: 12/518,560

(22) PCT Filed: Dec. 17, 2007

(86) PCT No.: PCT/CN2007/071248

§ 371 (c)(1),
(2), (4) Date: Jun. 10, 2009

(87) PCT Pub. No.: WO2008/074255

PCT Pub. Date: Jun. 26, 2008

(65) Prior Publication Data

US 2010/0019438 A1 Jan. 28, 2010

(30) Foreign Application Priority Data

Dec. 19, 2006 (CN) ..... 2006 1 0161766

(51) Int. Cl.
*B65H 5/02* (2006.01)

(52) U.S. Cl. ..... 271/275; 271/3.03; 271/225

(58) Field of Classification Search ..... 271/189, 271/3.03, 275, 245, 184, 198, 199, 225; 270/60; 414/789.9

See application file for complete search history.

(56) References Cited

U.S. PATENT DOCUMENTS

| | | | | |
|---|---|---|---|---|
| 3,683,943 | A * | 8/1972 | De Crepy | 271/301 |
| 4,007,669 | A * | 2/1977 | Achelpohl | 198/402 |
| 4,618,302 | A | 10/1986 | Kokubo et al. | |
| 4,747,493 | A * | 5/1988 | Nakanishi | 209/534 |
| 4,805,891 | A | 2/1989 | Luperti et al. | |
| 4,822,018 | A * | 4/1989 | Hain | 271/3.2 |
| 5,331,576 | A * | 7/1994 | Eckert et al. | 700/302 |
| 5,445,368 | A | 8/1995 | Lester et al. | |
| 5,553,528 | A * | 9/1996 | Zoltner | 83/443 |

(Continued)

FOREIGN PATENT DOCUMENTS

CN 1243288 C 5/2010

(Continued)

OTHER PUBLICATIONS

International Search Report from corresponding PCT/CN2007/071248 mailed Mar. 27, 2008.

(Continued)

*Primary Examiner* — Jeremy R Severson
(74) *Attorney, Agent, or Firm* — Alston & Bird LLP

(57) ABSTRACT

Disclosed are a recording medium accumulating device and a method for accumulating recording medium. The device includes a cylindroid roller for winding up the recording medium and at least two endless belts, peripheral surfaces of the cylindroid roller contact with external surfaces of the endless belts respectively, and a closed medium-feeding passage is formed between the contacting surfaces, a medium-entering passage and a medium-discharging passage for the recording medium are respectively formed between two adjacent endless belts, the medium-entering passage and the medium-discharging passage connect with the medium-feeding passage, the medium-feeding passage drives the recording medium to rotate with the cylindroid roller using the friction force of the contacting surfaces, so as to accumulate the recording medium.

18 Claims, 5 Drawing Sheets

U.S. PATENT DOCUMENTS

| | | | | |
|---|---|---|---|---|
| 6,077,030 | A | 6/2000 | Frochte et al. | |
| 6,786,479 | B2 * | 9/2004 | Gerlier et al. | 271/3.01 |
| 6,796,558 | B1 * | 9/2004 | Dorer | 271/189 |
| 7,441,695 | B1 * | 10/2008 | Saltsov et al. | 232/1 D |
| 7,789,296 | B2 * | 9/2010 | Haney et al. | 235/379 |
| 2005/0023747 | A1 * | 2/2005 | Dunlap et al. | 271/275 |

FOREIGN PATENT DOCUMENTS

| | | | |
|---|---|---|---|
| DE | 19500899 | | 7/1996 |
| DE | 19500899 | A1 * | 7/1996 |
| EP | 1220167 | | 7/2002 |
| JP | 50131598 | | 10/1975 |
| JP | 9-202510 | | 8/1995 |
| JP | 11110591 | | 4/1999 |
| WO | WO 96/15511 | | 5/1996 |

OTHER PUBLICATIONS

Written Opinion from corresponding PCT/CN2007/071248 mailed Mar. 27, 2008.

Korean Office Action mailed Sep. 14, 2011 for Application No. 10-2009-7014817.

EPO Extended Search Report for Application No. 07846074.8-1256 / 2096069, Patent No. PCT/CN2007071248, dated Nov. 21, 2011.

* cited by examiner

RECORDING MEDIUM ACCUMULATING DEVICE AND METHOD

CROSS REFERENCE TO RELATED APPLICATION

This application claims the benefit of CN Patent Application No. 200610161766.3, entitled "A RECORDING MEDIUM ACCUMULATING DEVICE AND METHOD" filed on Dec. 19, 2006 with State Intellectual Property Office of PRC, which is hereby incorporated by reference in its entirety.

FIELD OF THE INVENTION

The present invention relates to a device and a method for accumulating recording medium adapted to image forming devices, such as printers, copiers, fax machines, scanners, inquiry terminals and the like.

BACKGROUND

At present, on a common image forming device, such as a printer, a device for accumulating recording medium including papers etc. (in order to facilitate description, recording medium are hereinafter referred to as papers) is commonly installed, which is intended to avoid the printed pages from being taken away by users when the printing has not yet been finished and thus resulting in the loss of a part of the information. A printer with a medium accumulating device will not discharge the printed page from the printer until one sheet of printed page has been finished. However, a conventional printer with a medium accumulating device can only collect one piece of printed page at one time, i.e., after the printing of one piece of printed page has been finished, the piece of printed page will be discharged from the printer. However, when the printed contents are more than one sheet, users are not usually clear about how many pages are left behind, and thus often take the discharged printed pages away with those left behind being omitted, therefore resulting in a disclosure of users' information.

A device capable of accumulating a plurality of printed papers is disclosed in an international patent published in 2000 (Publication No. U.S. Pat. No. 6,077,030A). Referring to FIG. 1A, the device includes a drum cylinder 20 capable of receiving and accumulating a plurality of papers by means of predetermined portions in its periphery and a clamping means capable of clamping the front end of the paper, wherein the clamping mean includes at least a delivery roller 32 parallel to the drum cylinder, the delivery roller 32 clamps a predetermined portion of the printed paper and drives the printed paper to rotate with the drum cylinder. In this way, the printed papers are accumulated and clamped on the delivery roller 32. Also, the delivery roller 32 may discharge several pieces of printed papers out of the drum cylinder 20. This device, however, has the following disadvantages.

Firstly, the device needs to employ a clamping means to clamp the front edge of the paper by its pressure, such that the accumulating device can then operate normally. In this way, since it is necessary for the clamping means to open and close repeatedly, its clamping force will decrease gradually due to spring fatigue, which causes clamping failure, and thus the accumulating device fails to operate normally.

Secondly, as is shown in FIG. 1B, it is required for the device to rotate positively and negatively by means of two motors, i.e., with the reversible rotating of a first motor 66, the device controls the drum cylinder 20 to rotate reversibly and thus implements paper accumulating; with the reversible rotating of a second motor 82, the device controls the delivery roller 32 and pressing roller 36 to rotate positively and negatively and thus implement paper discharging. The structure involved is complicated and the cost for electric control is relatively high.

SUMMARY OF THE INVENTION

In view of this, the object of the present invention is to provide a recording medium accumulating device and method, which can work more reliablely and accumulate a plurality of printed papers, while the cost for electric control is low.

The recording medium accumulating device of the present invention includes a cylindroid roller for winding up the recording medium and at least two endless belts;

the external surfaces of the cylindroid roller contact with those of the endless belts respectively, a closed medium-feeding passage is formed between the contacting surfaces;

a medium-entering passage and a medium-discharge passage of the recording medium are respectively formed between two adjacent endless belts and the medium-entering passage and the medium-discharge passage connect with the medium-feeding passage;

the medium-feeding passage drives the recording medium to rotate with the cylindroid roller by a friction force of the contacting surfaces, so as to accumulate the recording medium.

Preferably, the said device further includes:

a position sensor located in the medium-feeding passage, for instructing the cylindroid roller to stop rotating when it detects that the recording medium has traveled to the position where the position sensor is, so as to wait for inputting of the second piece of recording medium.

Preferably, the said device further includes:

a medium-entering sensor located in the medium-entering passage, for detecting whether the medium-entering passage is paper jammed or whether there is a piece of paper entering into the medium-entering passage; and/or a first medium-discharging sensor located in the medium-discharging passage, for detecting whether the medium-discharging passage is paper jammed or whether the discharged recording medium has been taken away by a user.

Preferably, the cylindroid roller includes a roller and a peripheral belt supported by the roller.

Preferably, the roller is assembled by coupling of at least one cylindrical sleeve, with a roller mandrel passing through along its axle center.

Wherein a bearing is also disposed between the cylindrical sleeve and the roll mandrel for reducing the friction therebetween.

Preferably, the endless belts include a first belt, a second belt, and a third belt, wherein a first passage, a second passage, and a third passage are respectively formed at the positions where the first belt, the second belt, and the third belt contact with the peripheral surfaces of the cylindroid roller, and the three passages together form the closed medium-feeding passage;

the medium-discharging passage, the medium-withdrawing passage, and the medium-entering passage are respectively formed among the first belt, the second belt, and the third belt.

Preferably, the device further includes a medium-discharging floating plate located in the medium-discharging passage;

under the elastic force of a tension spring, one end of the medium-discharging floating plate contacts with the peripheral belt, therefore closing the medium-feeding passage in the direction from the second passage to the first passage.

Preferably, the said device further includes a medium-entering guiding plate positioned among the first passage, the third passage, and the medium-entering passage, such that a three-way intersection is formed.

Preferably, the device further includes a medium-withdrawing floating plate located in the medium-withdrawing passage, wherein, under the elastic force of the tension spring, one end of the medium-withdrawing floating plate contacts with the peripheral belt, therefore closing the medium-feeding passage in the direction from the third passage to the second passage.

Wherein, the said device further includes:

a second medium-discharging sensor located in the medium-withdrawing passage, for detecting whether a medium-withdrawing port is paper jammed or whether a recycle container is full.

Wherein, each of the endless belts is respectively supported by a driving shaft and at least one driven shaft, each of the endless belts is at least one set of belts.

Preferably, the device further includes a transport that enables the endless belts and the cylindroid roller to rotate together with the driving motor, the transport includes a motor gear, a transport gear and a transport belt;

the motor gear is fixed to one end of the rotating shaft of the driving motor, the transport gear is fixed to one end of the driving shaft and in one-to-one correspondence with the driving shafts, the transport belt is supported by the motor gear and the transport gear.

Preferably, the device further includes a transport that enables the endless belts and the cylindroid roller to rotate together with the driving motor, the transport includes a motor gear and a transport gear, the motor gear is fixed to one end of the rotating shaft of the driving motor and engages with the transport gear, the transport gear is fixed to one end of the driving shaft and in one-to-one correspondence with the driving shafts.

Preferably, the device further includes a handwheel that meshes with the transport gear on the driving shaft, so as to be able to drive the driving shaft to rotate by rotating the handwheel when the power is off.

The present invention provides a method of accumulating recording medium based on the technical solution described above, which includes:

A. the recording medium enters into a medium-feeding passage through a medium-entering passage of a recording medium accumulating device, wherein, the medium-feeding passage is formed by contacting of external surfaces of a cylindroid roller and endless belts in the recording medium accumulating device, and the medium-entering passage and a medium-discharging passage for the recording medium is respectively formed between two adjacent endless belts;

B. the medium-feeding passage drives the recording medium to rotate with the cylindroid roller by using the friction force of contacting surfaces, so as to accumulate the recording medium;

C. the accumulated recording medium is discharged through the medium-discharging passage.

Preferably, between the steps B and C, the method further includes:

when it is detected that the recording medium has traveled to a prescribed position in the medium-feeding passage, the cylindroid roller is made to stop rotating, so as to wait for the inputting of a second piece of recording medium.

Preferably, the step A in particular is:

when it is detected that recording medium enters into the medium-entering passage, the cylindroid roller is activated to rotate, and therefore carrying the recording medium into the medium-feeding passage.

Preferably, the step C in particular is:

when the accumulating of all recording medium is finished, the cylindroid roller is rotated negatively to drive the recording medium to be discharged to the medium-discharging passage.

Preferably, after the step C, the method also includes:

When it is detected that there is still recording medium in the medium-discharging passage, the cylindroid roller is activated to rotate, therefore carrying the recording medium back into the medium-feeding passage; and When it is detected that the recording medium has traveled to a prescribed position in the medium-feeding passage, the cylindroid roller is instructed to rotate negatively, so as to drive the recording medium to be discharged to the medium-withdrawing passage.

As compared to the prior art, the present invention has following advantages:

The present invention employs a medium-feeding passage consisted of at least two endless belts and the cylindroid roller described, therefore, using a friction force to perform feeding and accumulating of the recording medium, and guaranteeing a good friction force for the medium-feeding passage with the good elasticity of the belts.

DETAILED DESCRIPTION OF THE INVENTION

The technical solution of the present invention is as follows: the recording medium accumulating device includes a cylindroid roller for winding up the recording medium and at least two endless belts;

the external surfaces of the cylindroid roller contact with those of the endless belts respectively, a closed medium-feeding passage is formed between the contacting surfaces;

a medium-entering passage and a medium-discharge passage that facilitate the entering and discharging of the recording medium are respectively formed between two adjacent endless belts, and the medium-entering passage and the medium-discharge passage connect with the medium-feeding passage;

the medium-feeding passage drives the recording medium to rotate with the cylindroid roller by a friction force of the contacting surfaces, so as to accumulate the recording medium.

In the device, the cylindroid roller includes at least one roller and a peripheral belt. The peripheral belt includes one set or multiple sets of belts, preferably five endless belts, for example, which are supported by the cylindroid roller. The roller is assembled by coupling of at least one cylindrical sleeve, with a roller mandrel passing through along its axle center. Also, a bearing is disposed between the cylindrical sleeve and the roller mandrel to reduce the friction therebetween. The perimeter of the cylindroid roller is at least equal to the length of the paper. The endless belts are supported by a driving shaft and at least one driven shaft. Each of the endless belts is consisted of one set or multiple sets of belts.

The present invention preferably employs three medium-feeding passages constructed by a four-sectioned closed belt, which feeds and accumulates the recording medium by using the action of friction force. It should be noted that the recording medium described in the present invention is a paper-like medium which can be directly written and drawn thereon for recording images and words (in order to facilitate description, recording medium is hereinafter referred to as papers). Next, the embodiments of the present invention will be further described in detail with reference to the accompanying drawings.

Figure 1A:
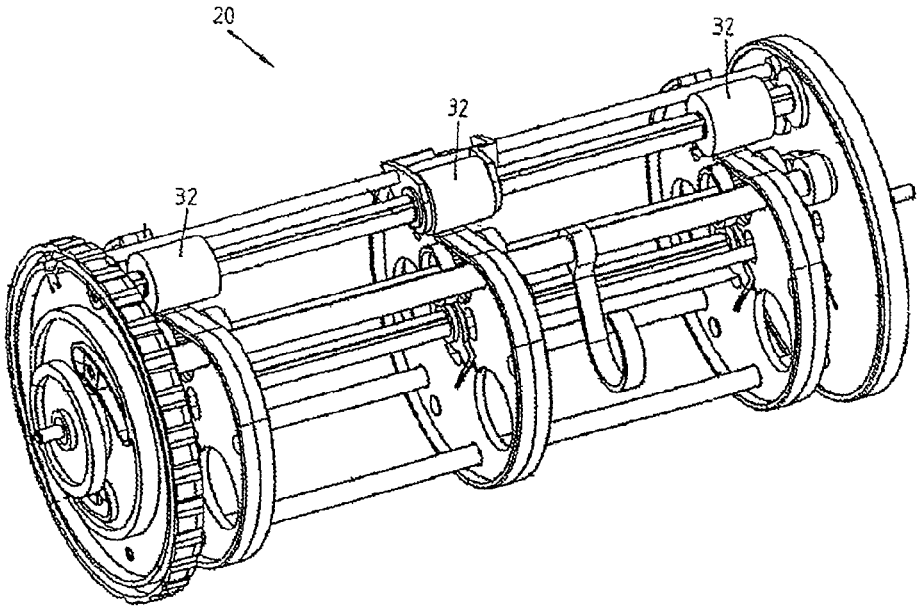
FIG.1A PRIOR ART
FIG. 1A is a schematic structural view of a device in the prior art capable of accumulating a plurality of papers.
Figure 1B:
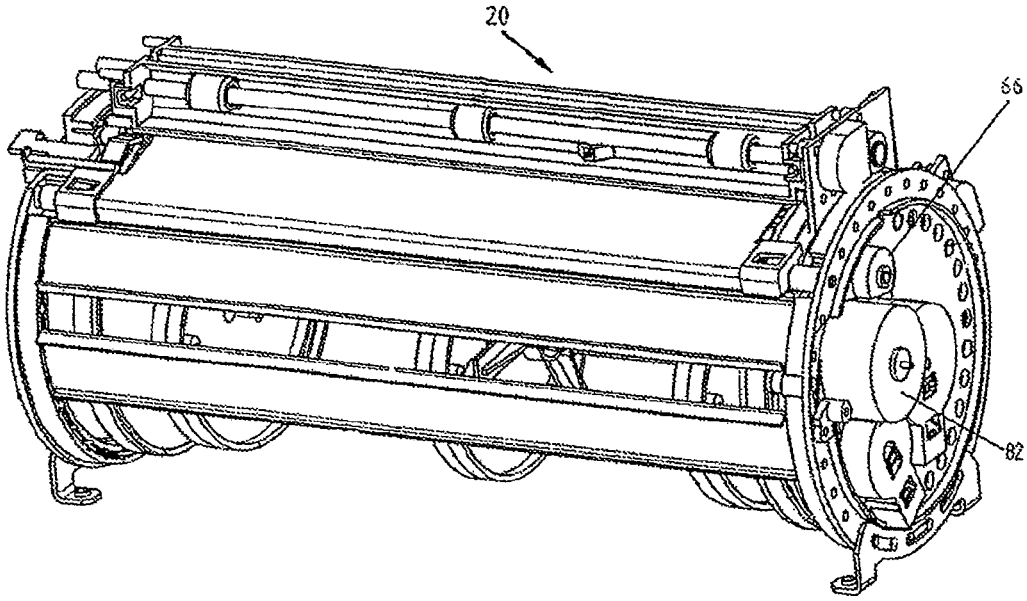
FIG.1B PRIOR ART
FIG. 1B is a schematic structural view of the positions of motors for a device in the prior art capable of accumulating a plurality of papers.
Figure 2:
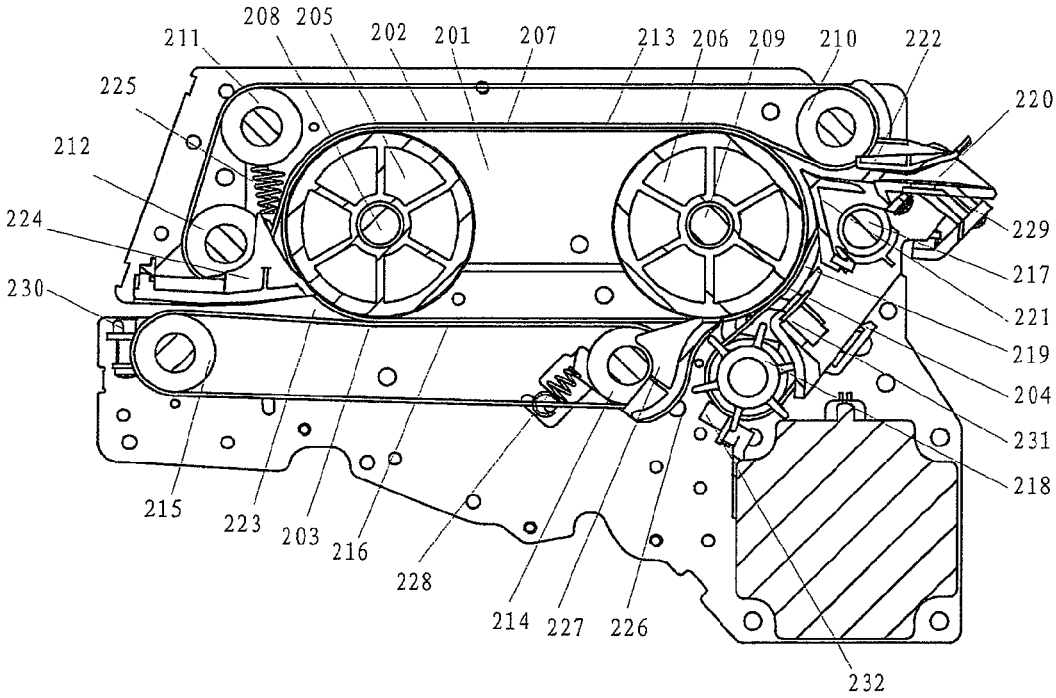
FIG. 2 is a schematic structural view of the first preferred embodiment of the present invention.

Referring to FIG. 2, which is a schematic structural view of the preferred embodiment of the device of the present invention. The present device includes a cylindroid roller 201, a first belt 202, a second belt 203, and a third belt 204. Here, the cylindroid roller 201 includes a first roller 205, a second roller 206, and a peripheral belt 207. Preferably, the peripheral belt 207 can be constructed by five endless belts, which are supported by the first roller 205 and the second roller 206. The first roller 205 and the second roller 206 are respectively assembled by coupling of several cylindrical sleeves, with a roller mandrel 208 passing through along the axle center thereof. Bearings 209 are disposed between the cylindrical sleeves at both ends and the roller mandrel 208 to reduce the friction between the cylindrical sleeves and the roller mandrel 208 when the cylindrical sleeves are rotating.

The first belt 202 is supported and constituted by a first driving shaft 210, a first driven shaft 211, and a second driven shaft 212. It contacts the top surface of the cylindroid roller 201 so that a first passage 213 is formed. Preferably, the first belt 202 includes five sections of endless belts. These five sections and the five endless belts at the peripheral of the cylindroid roller 201 correspondingly fit with each other. The first driving shaft 210 is provided at the rear end of the first belt 202, and the first driven shaft 211 and the second driven shaft 212 are provided at the front end of the first belt 202, in which the first driven shaft 211 is disposed at the upper portion of the front end of the cylindroid roller 201, and the second driven shaft 211 is disposed at the lower portion of the front end of the cylindroid roller 201.

The second belt 203 is supported and constituted by a second driving shaft 214 and a third driven shaft 215. The second belt 203 is in surface-contact with the bottom of the cylindroid roller so that a second passage 216 is formed. Preferably, the second belt 203 includes five endless belts. These five belts and the five endless belts at the peripheral of the cylindroid roller 201 correspondingly fit with each other. The second driving shaft 214 is provided at the rear end of the second belt 203, and the third driven shaft 215 is provided at the front end of the second belt 203.

The third belt 204 is supported and constituted by a third driving shaft 217 and a fourth driven shaft 218. The third belt 204 is in surface-contact with the back of the cylindroid roller 201 so that a third passage 219 is formed. Preferably, the third belt 204 includes five endless belts. These five belts and the five endless belts at the peripheral of the cylindroid roller 201 correspondingly fit with each other. The third driving shaft 217 is provided at the upper end of the third belt 204, and the fourth driven shaft 218 is provided at the lower end of the third belt.

The first passage 213, the second passage 216, and the third passage 219 form a closed loop medium-feeding passage. A medium-entering passage 220 is formed at the upper end of the back panel of the device. A medium-entering guiding plate 221 is positioned among the first passage 213, the third passage 219, and the medium-entering passage 220, forming a Y-shaped three-way intersection. A turnover panel 222 is provided at the medium-entering passage 220 above the medium-entering guiding plate 222, so as to remove paper jam by opening the turnover panel 222 when paper jam occurs in paper entering.

The medium-discharging passage 223 of this device is formed at the second driven shaft 212 of the first belt 202 and the third driven shaft 215 of the second belt 203. At the medium-discharging port, a medium-discharging floating plate 224 is provided. Both ends of the medium-discharging floating plate 224 are hingedly connected with the left and right side plates of the first passage 213 respectively. Behind each of the hinge points at both left and right ends of the medium-discharging floating plate 224, a first spring 225 is further provided. The other end of the first spring 225 is fixed on the left and right side plates at the first passage 213 of the frame of this device. The right end of the medium-discharging floating plate 224 is in contact with the peripheral belt 207 under the action of the spring 225, thereby closing the left end of the first passage 213. Meanwhile, the left end of the medium-discharging floating plate 224 is in surface-contact with the second belt 203, thereby closing the medium-discharging port. The medium-discharging floating plate 224 is rotatable around the hinge points when the tension of the spring is overcome by an external force. The medium-discharging floating plate 224 closes the medium-feeding passage when there is no paper at the medium-discharging floating plate 224 of the medium-feeding passage. At this time, a paper can only move toward the second belt 203 from the first belt 202 by pushing the medium-discharging floating plate 224 away, and thus opening the medium-feeding passage. If a paper moves toward the first belt 202 from the second belt 203 through the medium-feeding passage at the medium-discharging floating plate 224, it can not push the medium-discharging floating plate 224 away but can only be discharged from the medium-discharging port under the medium-discharging floating plate 224.

The medium-withdrawing passage 226 of the present accumulating device is formed at the second driving shaft 214 of the second belt 203 and the fourth driven shaft 218 of the third belt 204. Among the second passage 216, the third passage 219, and the medium-withdrawing passage 226, a medium-withdrawing floating plate 227 is provided. Both ends of the medium-withdrawing floating plate 227 are hingedly connected with the left and right side plates of the second passage 216 respectively. Behind each of the hinge points at both left and right ends of the medium-withdrawing floating plate 227, a second spring 228 is further provided. The other end of the second spring 228 is fixed on the left and right side plates at the second passage 216 of the frame of this device. The medium-withdrawing floating plate 227 is in contact with the peripheral belt 207 under the tension force of the second spring 228, thereby closing the right end of the second passage 216. The medium-withdrawing floating plate 227 is rotatable around the hinge points when the tension of the spring is overcome by an external force. The medium-withdrawing floating plate 227 closes the right end of the second passage 216 when no external force is exerted. At this time, when a paper moves toward the third belt 204 from the second belt 203, the paper can push the medium-withdrawing floating plate 227 away to open the medium-feeding passage. When a paper moves toward the second belt 203 from the third belt 204, it can not push the medium-withdrawing floating plate 227 away but can only be discharged from the medium-withdrawing port under the medium-withdrawing floating plate 227.

Furthermore, a medium-entering sensor 229 is also provided at the medium-entering passage 220 of the present device for detecting whether a paper jam occurs or whether there is a piece of paper discharged from a recording device and prepared to enter into the medium-entering passage 220 of the accumulating device. A first medium-discharging sensor 230 is provided in the proximity of the medium-discharging port of the present accumulating device for detecting whether a paper jam occurs or whether the discharged paper has been taken away by a user. A position sensor 231 is further provided above the medium-withdrawing floating plate 227 for determining the position of the paper during the operation of the accumulating device. A second medium-discharging sensor 232 is also provided in the proximity of the medium-withdrawing port for detecting whether there is a paper jam at the medium-withdrawing port or whether the corresponding recycle container has been filled with paper. When the recycle container has been filled with the printed pages, the second medium-discharging sensor 232 will be activated and thus gives an alarm, so as to clear the recycle container in time.

Next, the operating process of the recording medium accumulating device of the present invention for accumulating a plurality of papers will be described in conjunction with the embodiment described above.

A recording device transfers papers into the present recording medium accumulating device via the medium-entering passage 220. The medium-entering sensor 229 at the medium-entering passage 220 sends out a signal after it detects the paper, thus the motor is triggered to rotate positively, so as to drive the cylindroid roller 201 to rotate counterclockwise. Meantime, each of the first belt 202, the second belt 203, and the third belt 204 rotates clockwise. The paper enters into the first passage 231 under the friction force between the first belt 202 and the peripheral belt 207, and moves in counterclockwise direction. When the paper is carried to the medium-discharging floating plate 224, the front edge of the paper enters into the second passage 216 against the resistance of the tension spring 225 at the medium-discharging floating plate 224, and then the paper continues to move counterclockwise under the friction force between the second belt 203 and the peripheral belt 207. When the paper is carried to the medium-withdrawing floating plate 227, the front edge of the paper proceeds into the third passage 219 against the resistance of the tension spring 228 at the medium-withdrawing floating plate 227, and then the paper continues to move counterclockwise under the friction force between the third belt 204 and the peripheral belt 207. When the paper is carried to the position sensor 231 on the third passage 219, the position sensor 231 sends out a trigger signal after it detects the front edge of the paper. The motor continues to rotate and then stops after driving the front edge of the paper to travel a set distance. Here, the front edge of the paper stops at the third passage 219, the accumulating of the first piece of paper is finished.

After detecting that the second piece of paper has entered into the medium-entering passage 220, the medium-entering sensor 229 sends out a trigger signal, which triggers the motor to rotate positively, so as to drive the cylindroid roller 201 to rotate counterclockwise, causing the first and the second piece of paper flush with each other at their front edges and enter into the first passage 213 together, with the first piece of paper lying under the second one. Then, the accumulating of the second piece of paper is completed according to the above mentioned steps, and a plurality of papers are accumulated similarly. After the accumulating of all sheets has been completed, the motor rotates positively and drives the paper to travel to the second passage 216 and then to the third passage 219. After the position sensor 231 detects that there is a piece of paper passing by and determines that the rear edge of the paper has already been away from the position of the medium-discharging floating plate 224, it triggers the motor to rotate negatively, so as to drive the cylindroid roller 201 to rotate clockwise. At this time, the second belt 203 rotates counterclockwise, while the paper moves clockwise in the second passage 216 under the friction force between the second belt 203 and the peripheral belt 207. Since the right end of medium-discharging floating plate 224 closes the entrance of the left end of the first passage 213 under the action of the tension spring, the rear edge of the paper can only enter into the medium-discharging passage 223 by lifting up the left end of the medium-discharging floating plate 224 against the resistance of the tension spring 225.

The first medium-discharging sensor 230 sends out a signal and therefore the motor is triggered to stop rotating when the first medium-discharging sensor 230 located at the medium-discharging passage 223 detects that there is a piece of paper at the medium-discharging port and a part of the paper has already been discharged from the medium-discharging port by a distance while the other part of paper still remains in the second passage 216. At this time, the accumulating device stops working and waits for the paper to be taken away by a user.

If the paper is taken away by a user, the accumulating device finishes the accumulating task for this time, and performs the next one according to requirement. If the paper is still not taken away after a period of time, the motor rotates positively and drives the cylindroid roller 201 to rotate counterclockwise, therefore, the second belt 203 rotates clockwise, and the paper rotates counterclockwise and enters into the third passage 219 from the second passage 216 under the action of the friction force. When the position sensor 231 in the third passage 219 detects the rear edge of the paper, it sends out a signal, therefore the motor is triggered to rotate negatively and drives the cylindroid roller 201 to rotate clockwise. Then, the third belt 204 rotates counterclockwise while the paper rotates clockwise under the action of the friction force. Since the right end of the medium-withdrawing floating plate 227 closes the entrance at the right end of the second passage 216 under the action of the second spring 228, the rear edge of the paper can just enter into the medium-withdrawing passage 226 and fall into the recycle container.

The recording medium accumulating device provided in the present invention can be applied to image forming devices like printers, copiers, fax machines, etc., or cash dispensers. A printer with a multi-paper accumulating device of the present invention can accumulate a plurality of papers for the same printing task in the accumulating device described in the present invention and then discharge all the printed pages out of the printer when all contents have been printed.

Through utilizing a medium-feeding passage consisted of at least two endless belts and the described cylindroid roller, the embodiment of the device of the present invention described above performs feeding and accumulating of recording medium with a friction force, ensures good friction force for the medium-feeding passage through good elasticity of the belts thereof, and has a relatively high reliability. Meanwhile, through utilizing a position sensor cooperated with a medium-discharging floating plate, the present invention can achieve accumulating of a plurality of recording medium under the friction force.

Next, since the embodiment of the device of the present invention delivers and accumulates a plurality of recording medium by employing only one positively and negatively rotatable motor, the cost for electric control is relatively low.

Further, the described embodiment may also serve the function of paper recycle, such that by means of the accumulating device of the present embodiment, the paper which is not taken away by users may be transferred into a recycle container specifically for recycle, thereby ensuring that the paper is accumulated neatly and orderly without missing.

The structural relationship of the present device when applied to a printer will be described in conjunction with the above described embodiment in the following, referring to FIG. 3, which is a schematic structural view of the first embodiment of the present invention applied on a printer.

Figure 3:
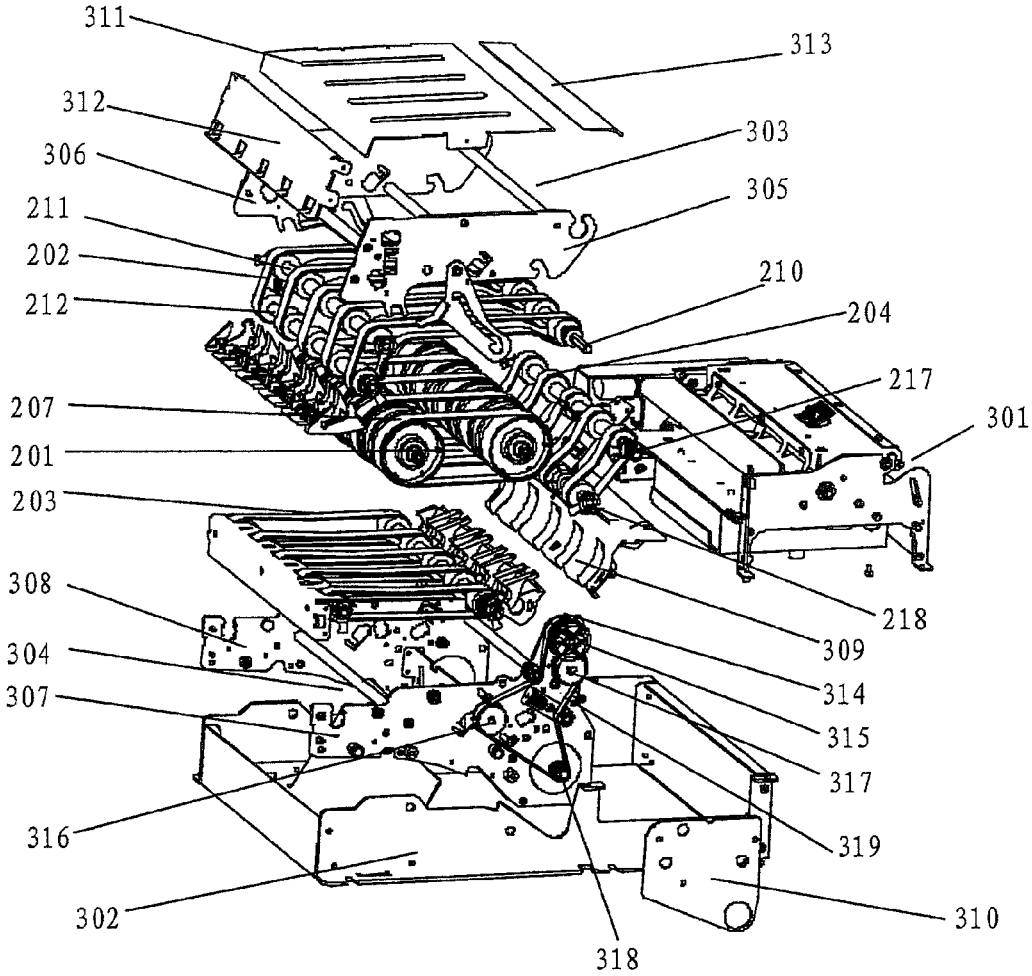
FIG. 3 is a schematic structural view of the first preferred embodiment of the present invention applied on a printer.

As is shown in FIG. 3, the printer includes a printing unit 301 and the present accumulating device at the discharging port of the printing unit 301, each of which is installed on the frame 302 of the printer. The printing unit 301 is a conventional thermal printing unit. The recording medium device includes a frame for supporting the whole accumulating device, a cylindroid roller, belts, and a transport assembly.

The belts include the first belt 202, the second belt 203, and the third belt 204; the frame includes a first passage supporting frame 303 and a second passage supporting frame 304. The first passage supporting frame 303 is formed by fixing of a left side plate 305 and a right side plate 306 of the first passage through three fixing axles. The second passage supporting frame 304 is formed by fixing of a left side plate 307 of the second passage, a right side plate 308 of the second passage, and the back panel 309 through one fixing axle and numbers of screws. The rear end of the first passage supporting frame 303 is hinged with the second passage supporting frame 304, such that the first passage supporting frame 303 can rotate around the hinge points. The transport 319 of the present accumulating device is disposed outside the left side plate 307 of the second passage. Preferably, the transport includes a motor gear, a transport gear, and a transport belt. The motor gear is fixed to an end of the rotating shaft of the driving motor. The transport gear is fixed to an end of the driving shaft and in one to one correspondence with the driving shaft. The transport belt is supported by the motor gear and the transport gear. Alternatively, the transport may also be consisted of a motor gear and a transport gear, wherein, the gear is fixed to an end of the rotating shaft of the driving motor and in mesh contact with the transport gear, and the transport gear is fixed to an end of the driving shaft and in one to one correspondence with the driving shaft. A gear cover plate 310 is provided outside of the transport 319. An upper cover plate 311 is further provided above the first passage supporting frame 303, and a front cover plate 312 in front, a back cover plate 313 back and above.

Within the first passage supporting frame 303, a cylindroid roller 201 for winding up papers thereon is disposed, which includes a first roller 205, a second roll 206, and five endless belts 207 winding along the peripheries thereof. Both ends of the roller mandrel 208 on the cylindroid roller 201 are supported by the left side plate 305 and the right side plate 306 of the first passage.

The first belt 202 is also disposed within the first passage supporting frame 303. The first belt 202 is disposed above the cyindroid roller 201 and supported by the first driving shaft 210, the first driven shaft 211, and the second driven shaft 212. Both ends of the driving shaft and the driven shaft are supported by the left side plate 305 and the right side plate 306 of the first passage. A first gear 314 is provided at the left end of the first driving shaft 210, a handwheel 315 is provided at the left side of the first gear 314, and the handwheel 315 is engaged with the first driving shaft 210 through the first gear 314, so as to remove the paper jammed within the accumulating device by turning the handwheel when the power is off.

Within the second passage supporting frame 304, the second belt 203 is disposed under the cylindroid roller 210 and constructed by five belts, which cooperate with the five belts 207 at the periphery of the cylindroid roller 201. The second belt 203 is supported by the second driving shaft 214 and the third driven shaft 215. Both ends of the second driving shaft 214 and the third driven shaft 215 are supported by the left side plate 307 and the right side plate 308 of the second passage. At the right end of the second driving shaft 214, a second gear 316 is further provided.

The third belt 204 is also disposed within the second passage supporting frame 304. The third belt 204 is disposed at the back of the cyindroid roller 201 and constructed by five belts, which cooperate with the five belts 207 at the periphery of the cylindroid roller 201. The third belt 204 is supported by the third driving shaft 217 and the fourth driven shaft 218. Both ends of the third driving shaft 217 and the fourth driven shaft 218 are supported by the left side plate 307 and the right side plate 308 of the second passage. At the left end of the third driving shaft 217, a third gear 317 is further provided. Bushings are provided on the above driving shafts and driven shafts at their fitting positions with each belt to increase the diameter of the shaft as well as the friction force between the shaft and the belt, and thus decreasing the slipping.

A driving motor is further disposed at the back lower end of the left side plate 307 of the second passage of the present accumulating device. The gear of this motor transmits the rotating movement of the motor to the first gear 314, the second gear 316, and the third gear 317 respectively by way of belt transport or gear transport, so as to drive each of the driving shafts, the driven shafts, the first roll 205, and the second roll 206 to rotate together, and thus to drive the first belt 202, the second belt 203, the third belt 204, and the peripheral belt 207 of the cylindroid roller 201 to move together.

Figure 4:
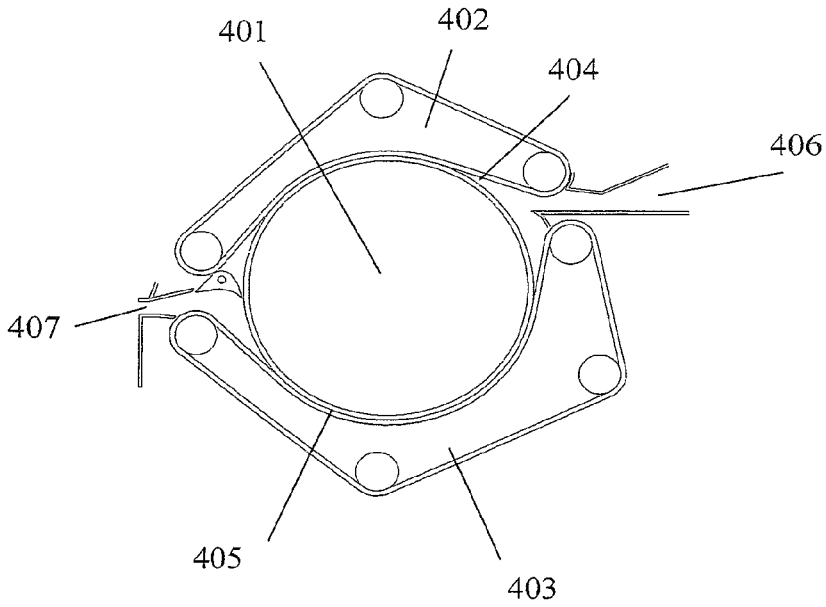
FIG. 4 is a schematic structural view of the second preferred embodiment of the present invention.
Figure 5:
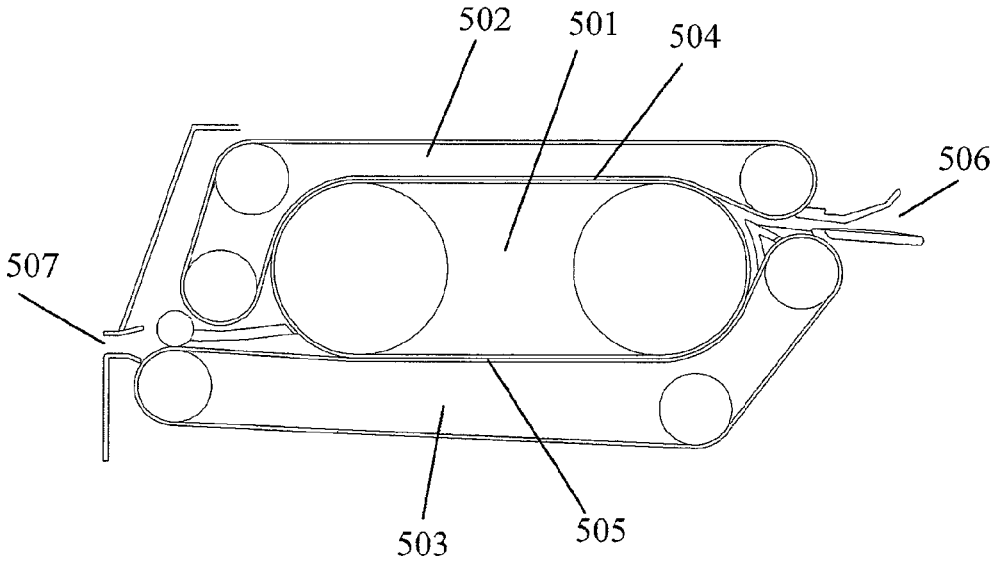
FIG. 5 is a schematic structural view of the third preferred embodiment of the present invention.

It should be noted that in the present invention the number of the endless belts may be two or more and the endless belts may be supported by one driving shaft and at least one driven shaft. When the number of the endless belts is two, the accumulating device has only one medium-entering port and one medium-discharging port. As is shown in FIGS. 4 and 5, which are schematic structural views of a accumulating device with only two endless belts, in which, FIG. 4 shows an embodiment with only one roller. In FIG. 4, the cylindroid roller 401 is consisted of one roller and a peripheral belt supported outside the roller. A first endless belt 402 and a second endless belt 403 are respectively in surface contact with the cylindroid roller 401 on its external surface, thereby forming a first medium-feeding passage 404 and a second medium-feeding passage 405. The first endless belt 402 is supported by one driving shaft and two driven shafts, and the second endless belt 403 is supported by one driving shaft and three driven shafts. At the surface contacting sites of the two endless belts respectively are a medium-entering port 406 and a medium-discharging port 407 of this device. FIG. 5 shows an embodiment with two rollers, in which the cylindroid roller 501 is consisted of two rollers and a peripheral belt supported outside the rollers. A first endless belt 502 and a second endless belt 503 are respectively in surface contact with the cylindroid roller 501 on its external surface, thereby forming a first medium-feeding passage 504 and a second medium-feeding passage 505. Both the first endless belt 502 and the second endless belt 503 are supported by one driving shaft and two driven shafts. At the surface contacting sites of the two endless belts respectively are a medium-entering port 506 and a medium-discharging port 507 of this device.

It is apparent that as the number of the endless belts increases, the number of the medium-entering port and the medium-discharging port will also increase. At least one belt will be added for every one additional medium-discharging port, and the number of the medium-discharging floating plate and the respective driving shaft and driven shaft may also increase correspondingly. Meanwhile, the positions of the medium-discharging port and the medium-entering port can be arranged according to the size or the position of the endless belt and adjusted as desired, so as to implement the function of multidirectional medium-discharging or multiple recycle containers.

Based on the solution described above, the method for accumulating recording medium provided by the present invention includes the following steps:

A. the recording medium enters into a medium-feeding passage through a medium-entering passage;

B. the medium-feeding passage drives the recording medium to rotate with the cylindroid roller using the friction force of contacting surfaces, so as to accumulate the recording medium;

C. the accumulated recording medium is discharged through a medium-discharging passage.

Figure 6:
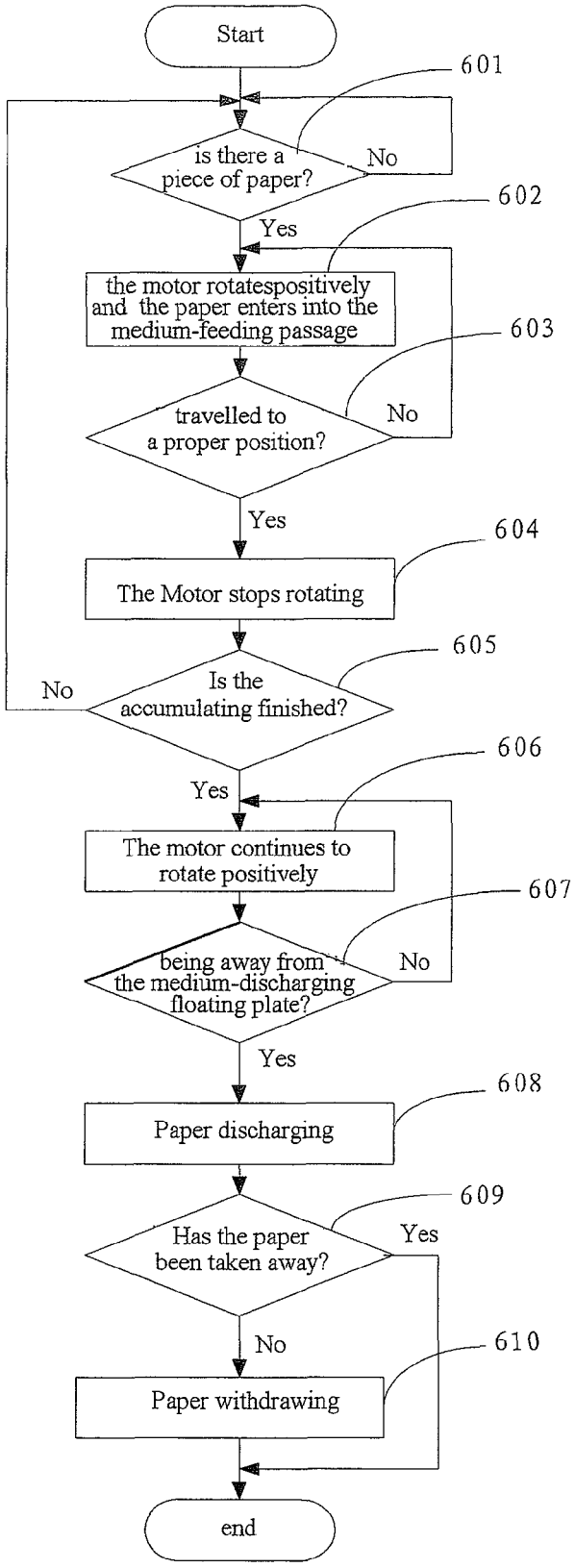
FIG. 6 is a schematic flowchart of the first preferred embodiment of the method of the present invention.

Referring to FIG. 6, which is a schematic flowchart of the first embodiment of the present invention. In the following, the specific process of the preferred first embodiment of the method for accumulating recording medium of the present invention will be described in conjunction with the recording medium accumulating device shown in FIG. 2:

At steps 601 and 602, when a piece of paper enters into the medium-feeding passage 220 and is detected by a medium-entering sensor 229, the medium-entering sensor 229 sends out a signal, then the motor rotates positively and in turn drives the cylindroid roller 201 to rotate counterclockwise, the first belt 202 to rotate clockwise, the second belt 203 to rotate clockwise, and the third belt 204 to rotate clockwise. The paper enters into the first passage 213 and moves in counterclockwise direction under the friction force between the first belt 202 and the peripheral belt 207. The front edge of the paper enters into the second passage 216 against the resistance of the tension spring 25 at the medium-discharging floating plate 224, thus the paper continues to move counterclockwise under the friction force between the second belt 203 and the peripheral belt 207. And then, the front edge of the paper enters into the third passage 219 against the resistance of the tension spring 228 of the medium-withdrawing floating plate 227, thus the paper continues to move counterclockwise under the friction force between the third belt 204 and the peripheral belt 207.

At step 603, the position sensor 231 determines whether the paper has traveled to a proper position. If it has, step 604 is performed; if it has not, return to step 602.

At step 604, the position sensor 231 instructs the motor to stop rotating, then the accumulating of the first piece of paper is finished.

At step 605, it is determined whether the accumulating of paper has finished. When the accumulating has finished, step 606 is performed; otherwise, return to step 601 and continue to accumulate the second piece of paper.

At step 606, the motor continues to rotate positively.

At step 607, the position sensor 231 determines whether the rear edge of the paper has travelled to the second passage 216 and been away from the position of the medium-discharging floating plate 224. If so, step 608 is performed; otherwise, return to step 606.

At step 608, the paper is discharged. The motor is triggered to rotate negatively by the position sensor 231. At this time, the cylindroid roller 201 rotates clockwise and the second belt 203 rotates counterclockwise. The paper, in turn, moves clockwise in the second passage 216 and enters into the medium-discharging passage 223 under the friction force between the second belt 203 and the peripheral belt 207. When the front edge of the paper still remains at the second passage 216 after the rear edge of the paper has been discharged from the medium-discharging port by a set distance, the accumulating device stops working and waits for the paper to be taken away by users.

At step 609, the first medium-discharging sensor 230 determines whether the paper has been taken away. If the paper has been taken away, the accumulating for this time ends, and the accumulating device performs the next accumulating task according to requirement; otherwise, the step 610 is performed.

At step 610, the paper is withdrew. The motor rotates positively and drives the cylindroid roller 201 to rotate counterclockwise and the second belt 203 to rotate clockwise. Then the paper rotates counterclockwise and enters from the second passage 216 into the third passage 219 under the action of the friction force. When the rear edge of the paper is detected by the position sensor 231, the motor rotates negatively and drives the cylindroid roller 201 to rotate clockwise and the third belt 204 to rotate counterclockwise. Accordingly, the rear edge of the paper enters into the port of the medium-withdrawing passage and then falls into the recycle container.

The embodiments of the present invention described above do not form limitations to the scope of protection for the present invention. All modifications, equivalent alternatives, and improvements within the spirits and the principles of the present invention should be included in the scope of protection for the present invention.

FIG. 6

Start

601 is there a piece of paper? Yes No

602 the motor rotates positively and the paper enters into the medium-feeding passage

603 travelled to a proper position?

604 The Motor stops rotating

605 Is the accumulating finished?

606 The motor continues to rotate positively

607 being away from the medium-discharging floating plate?

608 Paper discharging

609 Has the paper been taken away?

610 Paper withdrawing end

The invention claimed is:

1. A recording medium accumulating device comprising:

a cylindroid roller for winding up the recording medium and endless belts;

wherein, the cylindroid roller includes a roller and a peripheral belt supported by the roller;

the endless belts include a first belt, a second belt, and a third belt;

a first passage, a second passage, and a third passage are respectively formed at positions where the first belt, the second belt, and the third belt contact with the peripheral surfaces of the cylindroid roller, and the first, second, and third passages together form a closed medium-feeding passage;

a medium-discharging passage is formed between the first belt and the second belt;

a medium-withdrawing passage is formed between the second belt and the third belt;

a medium-entering passage is formed between the first belt and the third belt;

the medium-entering passage, the medium-withdrawing passage and the medium-discharging passage are connected with the medium-feeding passage; and the medium-feeding passage is configured to drive the recording medium to rotate with the cylindroid roller using the friction force of the contacting surfaces, so as to accumulate the recording medium.

2. The recording medium accumulating device according to claim 1, wherein the device further comprises:

a position sensor located in the medium-feeding passage configured for instructing the cylindroid roller to stop rotating when it detects that the recording medium has traveled to a position where the position sensor is located, so as to wait for input of a second piece of recording medium.

3. The recording medium accumulating device according to claim 2, wherein the device further comprises:

a medium-entering sensor located in the medium-entering passage configured for detecting whether the medium-entering passage is paper jammed or whether there is a piece of paper entering into the medium-entering passage; and a first medium-discharging sensor located in the medium-discharging passage configured for detecting whether the medium-discharging passage is paper jammed or whether the discharged recording medium has been removed by a user.

4. The recording medium accumulating device according to claim 1, wherein the roller is assembled by coupling of at least one cylindrical sleeve, with a roller mandrel passing through along its axle center.

5. The recording medium accumulating device according to claim 4, wherein a bearing is disposed between the cylindrical sleeve and the roller mandrel for reducing the friction there between.

6. The recording medium accumulating device according to claim 1, wherein:

the device further comprises a medium-discharging floating plate located in the medium-discharging passage; and under an elastic force of a tension spring, one end of the medium-discharging floating plate contacts with the peripheral belt, therefore closing the medium-feeding passage in the direction from the second passage to the first passage.

7. The recording medium accumulating device according to claim 1, wherein the device further comprises:

a medium-entering guiding plate positioned among the first passage, the third passage, and the medium-entering passage, such that a three-way intersection is formed.

8. The recording medium accumulating device according to claim 1, wherein:

the device further comprises a medium-withdrawing floating plate located in the medium-withdrawing passage; and under an elastic force of the tension spring, one end of the medium-withdrawing floating plate contacts with the peripheral belt, thereby closing the medium-feeding passage in the direction from the third passage to the second passage.

9. The recording medium accumulating device according to claim 1, wherein the device further comprises:

a second medium-discharging sensor located in the medium-withdrawing passage configured for detecting whether a medium-withdrawing port is paper jammed or whether a recycle container is full.

10. The recording medium accumulating device according to claim 1, wherein each of the endless belts is respectively supported by a driving shaft and at least one driven shaft, each of the endless belts is at least one set of belts.

11. The recording medium accumulating device according to claim 1, wherein:

the device further comprises a transport that enables the endless belts and the cylindroid roller to rotate together with the driving motor, the transport includes a motor gear, a transport gear and a transport belt; and the motor gear is fixed to one end of the rotating shaft of the driving motor, the transport gear is fixed to one end of the driving shaft and is in one-to-one correspondence with the driving shafts, the transport belt is supported by the motor gear and the transport gear.

12. The recording medium accumulating device according to claim 11, wherein, the device further comprises a handwheel that meshes with the transport gear on the driving shaft, so as to be able to drive the driving shaft to rotate by rotating the handwheel when power is off.

13. The recording medium accumulating device according to claim 1, wherein the device further comprises a transport that enables the endless belts and the cylindroid roller to rotate together with the driving motor, the transport includes a motor gear and a transport gear, the motor gear is fixed to one end of the rotating shaft of the driving motor and engages with the transport gear, the transport gear is fixed to one end of the driving shaft and is in one-to-one correspondence with the driving shafts.

14. A method for accumulating recording medium, the method comprising the steps of:

A. entering the recording medium into a medium-feeding passage through a medium-entering passage of a recording medium accumulating device, wherein the recording medium accumulating device comprises a cylindroid roller and endless belts, the cylindroid roller includes a roller and a peripheral belt supported by the roller, the endless belts include a first belt, a second belt, and a third belt; a first passage, a second passage, and a third passage are respectively formed at positions where the first belt, the second belt, and the third belt contact with the peripheral surfaces of the cylindroid roller, and the first, second, and third passages together form the closed medium-feeding passage;

a medium-discharging passage is formed between the first belt and the second belt; a medium-withdrawing passage is formed between the second belt and the third belt; the medium-entering passage is formed between the first belt and the third belt; and the medium-entering passage, the medium-withdrawing passage and the medium-discharging passage are connected with the medium-feeding passage;

B. having the medium-feeding passage drive the recording medium to rotate together with the cylindroid roller by using the friction force of contacting surfaces, so as to accumulate the recording medium; and C. discharging the accumulated recording medium through the medium-discharging passage.

15. The method for accumulating recording medium according to claim 14, wherein between the steps B and C, the method further comprises the steps of:

in response to detecting the recording medium has traveled to a prescribed position in the medium-feeding passage, having the cylindroid roller stop rotating, so as to wait for input of a second piece of recording medium.

16. The method for accumulating recording medium according to claim 14, wherein:

in response to detecting the recording medium entering into the medium-entering passage, activating the cylindroid roller to rotate, and therefore carry the recording medium into the medium-feeding passage.

17. The method for accumulating recording medium according to claim 14, wherein:

in response to detecting all recording medium being accumulated, rotating the cylindroid roller negatively to drive the recording medium to be discharged to the medium-discharging passage.

18. The method for accumulating recording medium according to claim 14, wherein, following the step C, the method further comprises the steps of:

in response to detecting that there is still recording medium in the medium-discharging passage, activating the cylindroid roller to rotate, therefore carrying the recording medium back into the medium-feeding passage; and in response to detecting that the recording medium has traveled to a prescribed position in the medium-feeding passage, instructing the cylindroid roller to rotate negatively, so as to drive the recording medium to be discharged to the medium-withdrawing passage.

* * * * *